US006499527B1

(12) United States Patent
Lindley, Jr.

(10) Patent No.: US 6,499,527 B1
(45) Date of Patent: Dec. 31, 2002

(54) SCREEN GUIDE AND METHOD

(75) Inventor: Jack R. Lindley, Jr., Burlington, NC (US)

(73) Assignee: Hoffman Industries, LLC, Burlington, NC (US)

( * ) Notice: Subject to any disclaimer, the term of this patent is extended or adjusted under 35 U.S.C. 154(b) by 0 days.

(21) Appl. No.: 09/872,803

(22) Filed: Jun. 4, 2001

(51) Int. Cl.[7] ..... A47H 1/00
(52) U.S. Cl. ..... 160/28; 160/271
(58) Field of Search ..... 160/28, 99, 100, 160/268.1, 271, 270, 240, 266; 49/505; 16/94 R, 96 R

(56) References Cited

U.S. PATENT DOCUMENTS 716,751 A * 12/1902 Phillips
1,067,075 A * 7/1913 Swanson
1,810,848 A * 6/1931 Nye
2,406,761 A 9/1946 Golkowski
2,826,789 A * 3/1958 Etling
3,553,891 A * 1/1971 Casebolt et al.
5,063,638 A * 11/1991 Howard et al.
5,544,689 A 8/1996 Wegner
5,915,443 A 6/1999 Lindley, Jr.
5,918,659 A * 7/1999 Lee
5,930,952 A * 8/1999 Ricci
6,135,186 A 10/2000 Lindley, Jr.

* cited by examiner

*Primary Examiner*—Blair M. Johnson

(57) ABSTRACT

A vertical guide for a roll-up type screen as used on windows and doors can be used either inside or outside as desired. The guide is placed in opposing relation on the left and right sides of the window or door and includes a first U-shaped retainer which is frictionally attached to a base. The guides allow the user to purchase screens for windows having various width openings since the guides can be adjusted horizontally to seal the edges of the screen and prevent insect and debris infiltration.

11 Claims, 2 Drawing Sheets

SCREEN GUIDE AND METHOD

FIELD OF THE INVENTION

The invention herein pertains to guides for screens such as roll-up screens for windows and doors and particularly pertains to guides which are adjustable to accommodate varying widths of windows.

DESCRIPTION OF THE PRIOR ART AND OBJECTIVES OF THE INVENTION

With the increased interest in roll-up type screens used for building windows and doors, suppliers have become increasingly concerned with such screens being available for windows made by different manufacturers. Although most manufacturers and distributors sell windows of standard widths, the frames and jamb separation or spacing of some standard width windows may vary from manufacturer to manufacturer. For example, windows sold as a 36" (93.97 cm) may vary as much as 1½" (3.81 cm), from jamb to jamb for different suppliers, thus creating a problem when purchasing a roll-up type screen. Manufacturers of such Roll-up type window screens in the past have had to either custom fit roll-up screens to a particular window or provide screens which will not fit certain windows since cutting the screens on site has proven unsatisfactory or at least difficult and time consuming.

Also, newer vinyl window jambs of double-hung windows often tend to bow or bend during raising and lowering, making screen guides difficult to properly fit and maintain screen edges.

Thus, with the problems above known throughout the industry, it is therefore an objective of the present invention to provide an adjustable screen guide and method for us e on doors, windows and the like which will maintain a sealing relation with the edges of a roll-up screen.

It is another objective of the present invention to provide a screen guide which can be easily mounted in existing windows, doors or the like and can be removed easily for cleaning, painting or maintenance, purposes.

It is a further objective of the present invention to provide screen guides for opposing window jambs or interior stops formed from a PVC or other conventional polymeric material which can be used either inside or outside the window as required.

It is also an objective of the present invention to provide a screen guide having a retainer which is slidably connected to a frangible stem of a base for use in making adjustments during installation.

Various other objectives, advantages and details of the present invention will become apparent to those skilled in the art as a more detailed description is set forth below.

SUMMARY OF THE INVENTION

The aforesaid and other objectives are realized by providing screen guides for windows, doors and for other openings which are positioned in opposing relation such as on left and right window jambs for use with roll-up type window screens. The screen guides can be readily removed for cleaning of "tilt-out" type window sashes. The edges of the screens are positioned within the guides and the screens can then be lowered and raised while maintaining a sealing relation with the window to prevent infiltration of insects, debris or the like. The screen guides are formed preferably from suitable polymeric materials such as polyvinylchloride (PVC) for ease in installation, durability and relatively low cost. Certain metals such as aluminum or other materials could also be used as desired. The guides include a retainer which has a first wide U-shaped portion for receiving the screen within. The open portions of the U's are affixed in opposing relation, generally on left and right window jambs to allow windows of somewhat varying size openings in width to be employed. Each retainer also includes a second narrow U-shaped portion for engagement of a frangible stem on a base. The stem can be broken or cut along preformed indentations to allow it to be shortened to accommodate wider openings. The base frictionally engages a mounting member which is affixed to the window jamb by the use of screws and/or adhesives. The screen guides thus retain opposite edges of the screen in firm sliding relation to the window jambs to prevent unwanted insect infiltration while being adjustable to increase or decrease the distance therebetween to accommodate windows having somewhat slightly different openings and to allow for easy guide removal for window cleaning and servicing.

DETAILED DESCRIPTION OF THE PREFERRED EMBODIMENT AND OPERATION OF THE INVENTION

Figure 1:
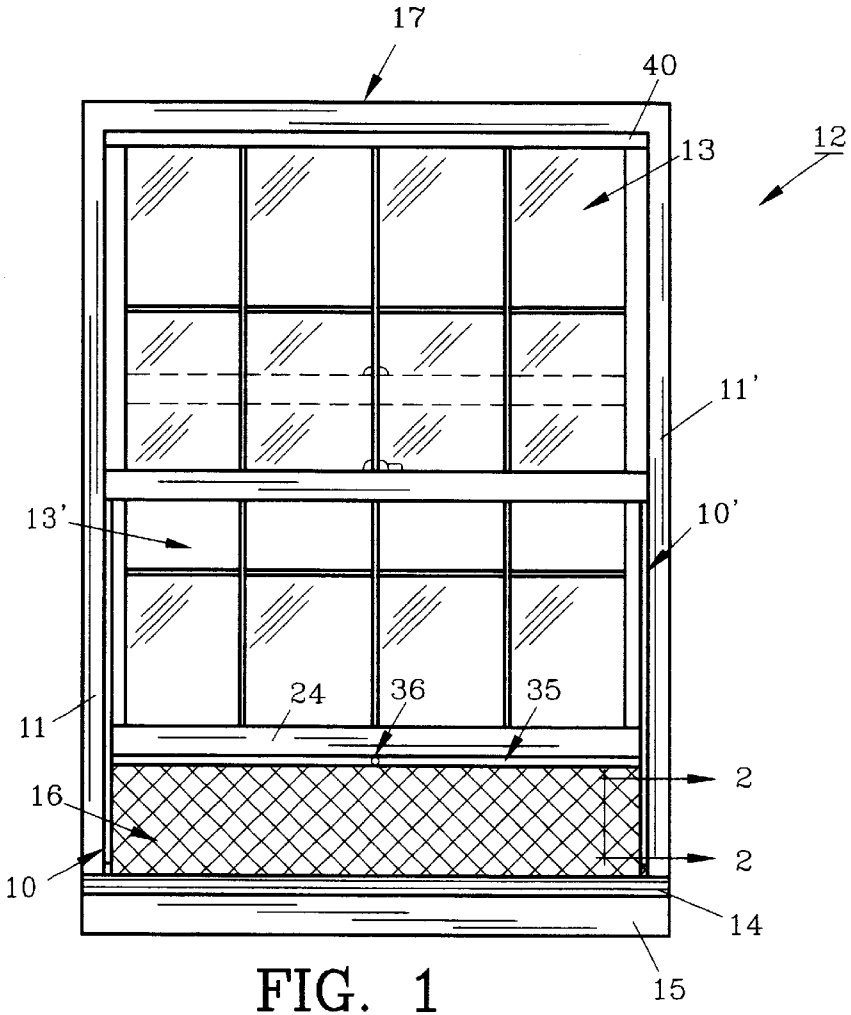
FIG. 1 demonstrates a typical double-hung window with an extended roll-up screen within screen guides of the invention.

For a better understanding of the invention and its operation, turning now to the drawings, FIG. 1 shows preferred left screen guide 10 and preferred right screen guide 10' mounted respectively along left window jamb 11 and right window jamb 11' of standard double-hung window 12. As used herein, window generally refers to a typical double-hung or other window, but can also mean door or other structure as used in a typical building opening. Window 12 comprises in an exterior view, a typical double-hung house window having a top sash 13 and lower sash 13' with roll-up screen 16 affixed in pivoting fashion, seen raised somewhat from window sill 14. Window sill 14 and bottom molding 15 conceal a roll-up type window screen apparatus (not shown) as conventional. Window screen 16 passes upwardly through window sill 14 and is shown unrolled in FIG. 1 within guides 10, 10' attached to jambs 11, 11'. Leader bar 35 of screen 16 is pivotally joined to bottom sash member 24 of lower sash 13' by pivot axle 36. A roll-up type window screen apparatus could also be fastened along upper sash member 40 to upper window sash 13 or otherwise as is usual in the trade. Window screen 16 may be formed of aluminum, polymeric materials, fiberglass or otherwise as is also common in the industry and has openings sized to prevent insect and debris infiltration. As would be understood, as window screen 16 is lowered from its extended position as shown in FIG. 1, it winds on concealed apparatus below sill 14 as is usual and the side edges of screen 16 slide within screen guides 10, 10' to maintain screen 16 in a straight, even posture to prevent binding while preventing infiltration along the edges of screen 16. Pivot axle 36 allows leader bar 35 of screen 16 to pivot to maintain it in straight, even alignment. Various other types of roll-up screens and window attachments are known and the example as described and shown in FIG. 1 is but one of many that can be utilized.

Figure 3:
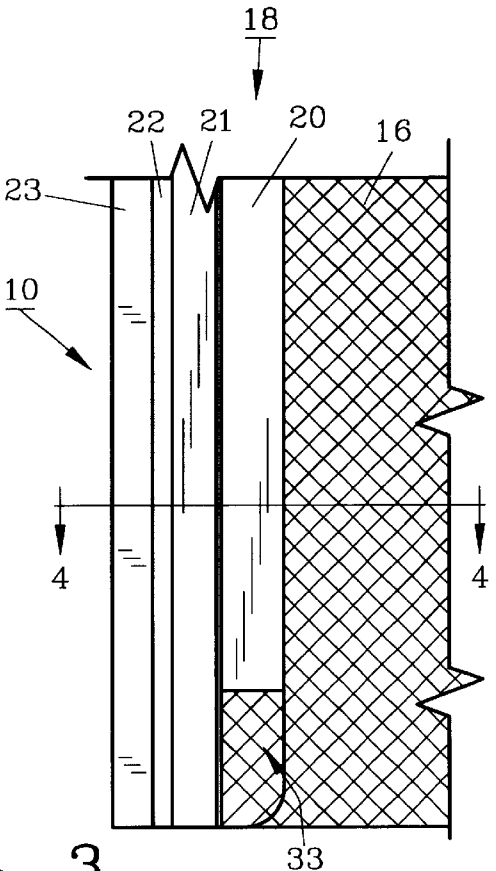
FIG. 3 illustrates an enlarged view of a cut-away portion of the bottom of the screen guide and screen as seen in FIG. 1.
Figure 5:
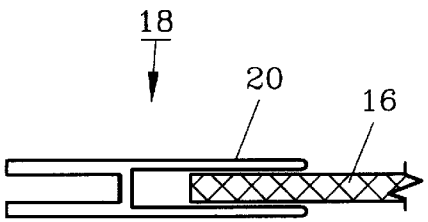
FIG. 5 depicts the screen retainer as shown in FIG. 4 as with a screen of lesser width or a wider width window opening.
Figure 2:
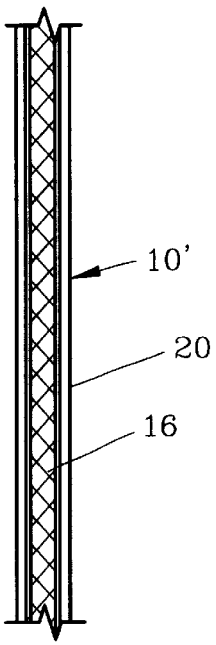
FIG. 2 shows a view of the screen within a window guide along lines 2—2 as shown in FIG. 1.

In enlarged FIG. 2 screen 16 is shown in screen guide 10' illustrating its placement within first wide U-shaped portion 20 of retainer 18 as along lines 2—2 in FIG. 1. Guide 10 as shown in FIG. 3 includes retainer 18 with a first wide U-shaped portion 20, and a second narrow U-shaped portion 21 joined in opposing relation. Base 19 seen in exploded form in FIG. 4 includes stem 22 and trunk 23 integrally formed as by extrusion molding. As further shown in FIG. 3, first wide U-shaped portion 20 defines notch 33 which is helpful in initially inserting screen 16. therein such as during installation and positioning retainer 18 properly relative to base 19 and for resetting screens as needed.

Figure 7:
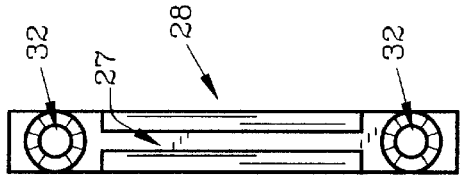
FIG. 7 shows the mounting member of FIG. 6 as along lines 7—7 of FIG. 6.
Figure 6:
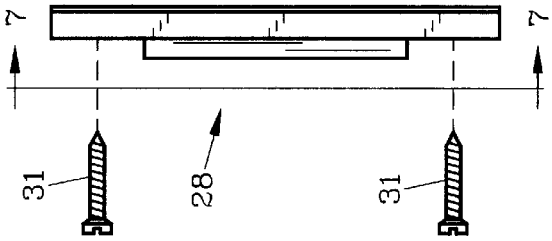
FIG. 6 illustrates a side view of one mounting member.
Figure 4:
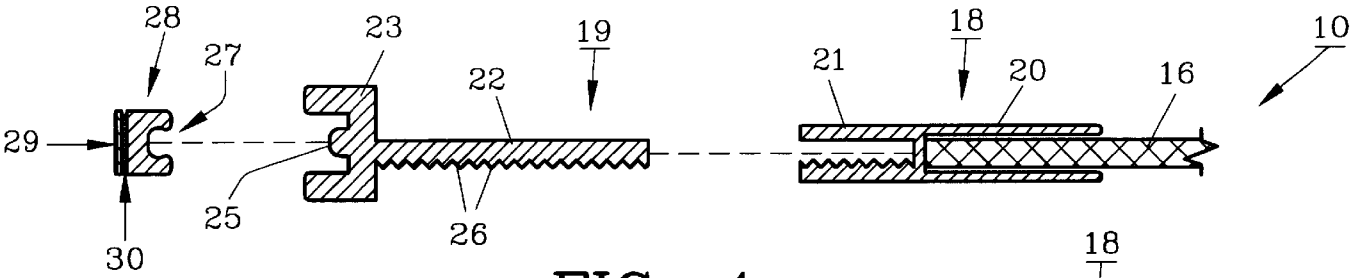
FIG. 4 features an exploded view of the window guide as seen in FIG. 3 along lines 4—4.

Further in FIG. 4 (seen along lines 4—4 of FIG. 3), mounting member 28 defines channel 27 which "snaps" onto ridge 25 of trunk 23. Mounting member 28 is provided with peel-off paper strip 29 which protects adhesive 30 therebetween. Thus, mounting member 28 can be attached to a typical window jamb such as window jamb 11 by use of adhesive 30 as seen in FIG. 4 or screws 31 (FIG. 6) can be utilized as required. As seen in FIG. 7, mounting member 28 has apertures 32 for easily inserting screws 31. First wide U-shaped portion 20 is also seen with smooth interior walls to readily guide screen 16.

Preferred screen guide 10 as shown in FIGS. 3 and 4 is formed from a lightweight polymeric material and is flexible and easily adjusted horizontally to window openings of various widths, as stem 22 is received within narrow second U-shaped portion 21 of retainer 18 whereas screen 16 is received within first wide U-shaped portion 20 of retainer 18. To obtain the exact distance between screen guides 10, 10' as shown in FIG. 1 to allow a proper, minimum distance therebetween, stem 22 of base 19 can be adjusted by manually breaking or cutting it along indented areas 26 as required. For a narrow screen or wide opening, stem 22 would be left relatively long as shown in FIG. 4 whereas if screen 16 is relatively wide or the opening is relatively narrow, stem 22 would be broken or cut to increase the distance between opposing guides 10, 10' as one way to accommodate a narrower window opening width. The length of first wide U-shaped portion 20 allows variations in the screen width or window opening also. As would be understood, guides 10, 10' as seen can be readily removed such as when used on "tilt-out" windows during maintenance or cleaning.

The preferred method of using screen guides such as screen guides 10, 10' as shown in FIG. 1 includes the steps of affixing a selected number (usually three although larger windows may require more) mounting members 28 to opposing window jambs, doors or the like as shown in FIG. 1 by attaching mounting member 28 with screws 31, with mounting members 28 spaced approximately 20 cm apart. (Describing only one side of the window); base 19 is then pressed onto mounting members 28 along window jamb 11. Screen retainer 18 is then slid onto stem 22 (shortened as needed) via narrow U-shaped portion 21. With vertical screen guides on both sides of the window so installed, screen 16 is then positioned within retainer 18 by first inserting the top edge within notches 33 shown in FIG. 3. Should the screen be too wide to conveniently fit within first wide U-shaped portion 20 of guides 10, 10', retainer 18 is removed from stem 22 of base 19 and stem 22 is further broken or cut along indentations 26 as required. With stem 22 thus modified, retainer 18 is then repositioned on stem 22 and screen 16 inserted and slid within first wide U-shaped portion 20. Screen 16 can then be slid along guides 10, 10' as needed by raising and lowering the window sash to which it is attached with the edges of screen 16 being slidably secure to the window jambs and preventing insect infiltration.

The illustrations and examples provided herein are for explanatory purposes and are not intended to limit the scope of the appended claims.

I claim:

1. A guide for mounting along the side of a window to contain a movable window screen, comprising: a vertically elongated retainer, said retainer comprising a first U-shaped portion, said first U-shaped portion for containing said window screen, said first U-shaped portion defining smooth interior walls, a mounting member, said mounting member defining a channel, and a base, said base slidably received in said channel, said first U-shaped portion adjustably joined to said base, said mounting member adapted to be affixed to said window whereby said first U-shaped portion can move horizontally from the side of the window to accommodate screens of various widths.

2. The guide of claim 1 wherein said base comprises a stem, said stem defining a plurality of indentions therealong, said retainer slidably engaging said stem.

3. The guide of claim 1 wherein said retainer further comprises a second U-shaped portion, said first U-shaped portion attached to said second U-shaped portion in back to back relation.

4. The guide of claim 3 wherein said second U-shaped portion defines a plurality of indentions for slidably engaging said stem.

5. The guide of claim 1 formed from plastic.

6. The guide of claim 1 formed from metal.

7. A pair of guides for vertical attachment along the sides of a window for containing a moving window screen therebetween, and a window screen in combination therewith comprising a roll-up screen, and each guide comprising: an elongated retainer, said retainer comprising a first U-shaped portion for receiving said roll-up screen, said first U-shaped portion defining smooth inner walls, a second U-shaped portion, said second U-shaped portion defining an indented wall, said first U-shaped portion joined to said second U-shaped portion, a base, said second U-shaped portion affixed to said base, a mounting member, said mounting member attached to said base, said mounting member adapted to be affixed to said window to allow said first U-shaped portion to horizontally adjust relative to said mounting member to accommodate roll-up screens of varying widths for guiding said screen.

8. The guide for a screen as claimed in claim whereas said base is slidably positioned within said mounting member.

9. A method of guiding a moving screen over an opening in a building with a vertical screen retainer having a first U-shaped portion with smooth inner walls, a second U-shaped portion with an indented wall, a base mounted along one side of the opening with the first U-shaped portion horizontally adjustable relative to the base for receiving the screen, comprising the steps of:

a) attaching the screen retainer to the base along one side of the opening;

b) positioning the edge of the screen in the first U-shaped portion; and c) adjusting the first U-shaped portion from the base to accommodate the screen.

10. The method of claim 9 further comprising the step of attaching screen retainers to opposite sides of the opening.

11. The method of claim 10 further comprising the step of moving the screen along the retainers to thereby guide the screen.

* * * * *